United States Patent [19]

Raubenheimer

[11] Patent Number: 4,656,683

[45] Date of Patent: Apr. 14, 1987

[54] SUCTION CLEANER FOR SUBMERGED SURFACES

[75] Inventor: Johann N. Raubenheimer, Transvaal, South Africa

[73] Assignee: Fahet NV, Curacao, Netherlands Antilles

[21] Appl. No.: 769,743

[22] Filed: Aug. 27, 1985

[30] Foreign Application Priority Data

Dec. 18, 1984 [ZA] South Africa ..... 84/9853

[51] Int. Cl.[4] ..... E04H 3/20

[52] U.S. Cl. ..... 15/1.7; 15/415 R

[58] Field of Search ..... 15/1.7, 415 R, 340, 15/415 A, 387

[56] References Cited

U.S. PATENT DOCUMENTS

| | | | |
|---|---|---|---|
| 3,008,160 | 11/1961 | West | 15/1.7 |
| 3,551,930 | 1/1971 | Myers | 15/1.7 |
| 4,365,375 | 12/1982 | Grodin et al. | 15/1.7 |
| 4,449,265 | 5/1984 | Hoy | 15/1.7 |
| 4,521,933 | 6/1985 | Raubenheimer | 15/1.7 |
| 4,553,284 | 11/1985 | Strumbos | 15/415 R |

*Primary Examiner*—Edward L. Roberts

*Attorney, Agent, or Firm*—Birch, Stewart, Kolasch & Birch

[57] ABSTRACT

A suction cleaner for swimming pools with a driving turbine has a suction nozzle projected at the turbine which nozzle is made of silicone rubber so that it can distend to allow large objects to pass through.

3 Claims, 3 Drawing Figures

SUCTION CLEANER FOR SUBMERGED SURFACES

BACKGROUND OF THE INVENTION

This invention relates to a suction cleaner for submerged surfaces.

One highly successful suction cleaner utilises a water turbine driven by water flowing through the cleaner to drive and steer the cleaner. A problem which does arise is that the inlet to the cleaner head is formed as a nozzle directed at the turbine impeller, and that the nozzle sometimes gets blocked by foreign objects which have fallen into the water.

It is an object of the invention to alleviate this problem.

SUMMARY OF THE INVENTION

According to the invention a suction cleaner head for use on a submerged surface comprises:

a turbine housing, a suction inlet in the base of the housing, an outlet from the housing adapted to be connected to a suction hose, a shaft journalled in the housing, a turbine mounted on the shaft, means driven by the shaft for causing the head to move over the submerged surface, and a nozzle projecting from the inlet at the turbine, the nozzle being formed of a resiliently deformable material, such as rubber and preferably silicone rubber. The means driven by the shaft could be the rocker and feet mechanism described in US patent application Ser. No. 480,360 filed Mar. 30, 1983 and South African patent No. 83/2179 or the endless track drive described in US patent application Ser. No. 532,176 filed Sept. 14, 1983 and South African patent No. 83/6739.

DESCRIPTION OF THE DRAWINGS

FIG. 3 is a view similar to FIG. 2 showing an object passing through.

DESCRIPTION OF AN EMBODIMENT

Figure 1:
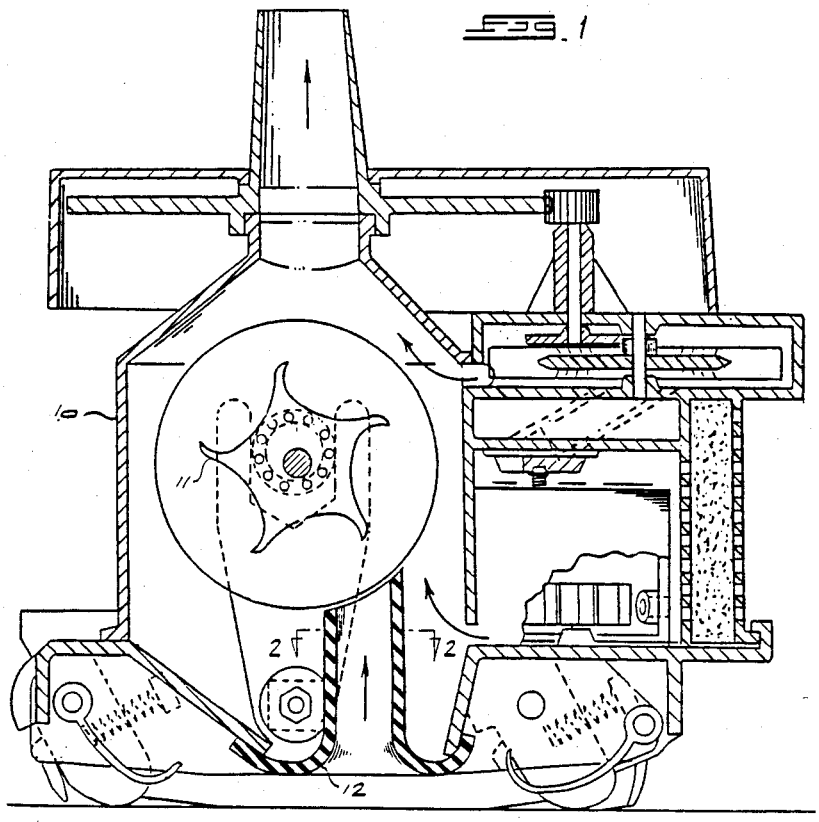
FIG. 1 is a section through a suction cleaner.

FIG. 1 illustrates the suction cleaner which has been described in the complete specification of South African patent No. 83/2179. The modification brought about by the present invention is that the inlet to the casing 10 in which the turbine 11 operates is formed by a nozzle 12 made of a silicone rubber.

Figure 2:
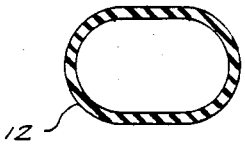
FIG. 2 is a section on the line 2—2.
Figure 3:
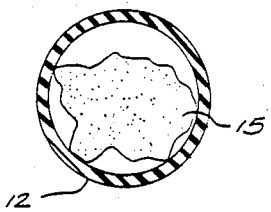

FIG. 2 is a section though the nozzle 12 in the normal course of operations while FIG. 3 shows the nozzle 12 with a stone 13 passing through.

A major advantage of the present invention is that the nozzle 12 can be made of a relatively small cross-sectional area for the cleaner to work with relatively low power suction pumps. With these devices the smaller the nozzle the more likely is it that it will be blocked. With the improvement of the present invention the nozzle is largely self-clearing.

I claim:

1. A suction cleaner head for use on a submerged surface comprising:

a turbine housing, a suction inlet in the base of the housing, an outlet from the housing adapted to be connected to a suction hose, a shaft journalled in the housing, a turbine mounted on the shaft, means driven by the shaft for causing the head to move over the submerged surface, and a nozzle projecting from the inlet to the turbine, the nozzle being formed of a resiliently deformable material.

2. The suction cleaner claimed in claim 1 in which the nozzle is made of 15 rubber.

3. The suction cleaner claimed in claim 2 in which the rubber is silicone rubber.

* * * * *